US011319097B2

(12) United States Patent
Huber

(10) Patent No.: US 11,319,097 B2
(45) Date of Patent: May 3, 2022

(54) LOWER TOOL FOR VACUUM SKIN PACKAGING

(71) Applicant: Buergofol GmbH, Siegenburg (DE)

(72) Inventor: Christian Huber, Rain (DE)

(73) Assignee: Buergofol GmbH, Siegenburg (DE)

( * ) Notice: Subject to any disclaimer, the term of this patent is extended or adjusted under 35 U.S.C. 154(b) by 49 days.

(21) Appl. No.: 16/786,534

(22) Filed: Feb. 10, 2020

(65) Prior Publication Data

US 2020/0255175 A1 Aug. 13, 2020

(30) Foreign Application Priority Data

Feb. 8, 2019 (DE) ..... 102019103196.6

(51) Int. Cl.

*B65B 7/16* (2006.01)
*B65B 9/04* (2006.01)
*B65B 11/52* (2006.01)
(Continued)

(52) U.S. Cl.

CPC ..... *B65B 31/028* (2013.01); *B65B 7/165* (2013.01); *B65B 9/04* (2013.01); *B65B 11/52* (2013.01); *B65B 31/04* (2013.01); *B65B 59/04* (2013.01)

(58) Field of Classification Search

CPC ..... B65B 7/164; B65B 7/165; B65B 9/04; B65B 11/52; B65B 15/00; B65B 15/02;
(Continued)

(56) References Cited

U.S. PATENT DOCUMENTS 3,353,218 A * 11/1967 Cloud et al. ..... B65B 47/06 425/182
3,537,229 A * 11/1970 Prena ..... B65B 31/02 53/559
(Continued)

FOREIGN PATENT DOCUMENTS

DE 9010832 U1 7/1990
DE 10022269 A1 5/2000
(Continued)

OTHER PUBLICATIONS

Search report of the German Patent Office in the related German patent application DE102019103196.6 dated Sep. 11, 2019 (10 pages).

*Primary Examiner* — Stephen F. Gerrity
(74) *Attorney, Agent, or Firm* — Imperium Patent Works; Darien K. Wallace

(57) ABSTRACT

A novel lower tool enables a packaging machine having a molding station with a trough to be used to produce skin packaging having a flat base plate. The lower tool includes a body base and a flat upper surface and is arranged in the molding station of the packaging machine such that the flat upper surface of the lower tool covers the trough. The lower tool fits detachably into a lower tool holder of the packaging machine. During the packaging production, the flat upper surface supports the flat base plate of the packaging. Suction applied via a passage through the flat upper surface is used to hold the flat base plate onto the flat upper surface. The lower tool is a means for converting the packaging machine from producing a first type of packaging having a trough-shaped carrier into producing a second type of packaging that has a flat carrier.

20 Claims, 5 Drawing Sheets

(51) Int. Cl.
*B65B 59/04* (2006.01)
*B65B 31/02* (2006.01)
*B65B 31/04* (2006.01)

(58) Field of Classification Search
CPC ..... B65B 31/028; B65B 47/00; B65B 47/04; B65B 47/08; B65B 47/10; B65B 59/04
USPC ..... 53/201, 427, 509, 453, 559
See application file for complete search history.

(56) References Cited

U.S. PATENT DOCUMENTS 3,775,932 A * 12/1973 Jeney ..... B65B 7/164 53/201
3,830,365 A * 8/1974 Krueger et al. ..... B65D 75/305 53/427
3,945,172 A * 3/1976 Johnson ..... B65B 11/52 53/509
4,034,536 A * 7/1977 Mahaffy et al. ..... B65B 9/04 53/427
4,229,927 A * 10/1980 Day ..... B65B 47/02 53/453
4,349,999 A * 9/1982 Mahaffy et al. ..... B65B 61/18 53/559
5,747,179 A * 5/1998 Matsen ..... B29C 65/32 428/586
2019/0185188 A1* 6/2019 Palumbo ..... B65B 11/52
2019/0241296 A1* 8/2019 Mondini et al. ..... B65B 11/52
2021/0122513 A1* 4/2021 Rizzi et al. ..... B65B 7/164
2021/0292019 A1* 9/2021 Chevalier et al. ..... B65B 59/04

FOREIGN PATENT DOCUMENTS

DE 202006010803 U1 7/2006
DE 102011100429 A1 5/2011
DE 102011101053 A1 5/2011
DE 102011113968 A1 9/2011
EP 2722279 B1 10/2012
EP 2985234 B1 8/2014
FR 3056195 A1 * 3/2018 ..... B65B 11/52
WO WO2018/141372 A1 1/2017

* cited by examiner

LOWER TOOL FOR VACUUM SKIN PACKAGING

CROSS REFERENCE TO RELATED APPLICATION

This application is based on and hereby claims the benefit under 35 U.S.C. § 119 from German Patent Application No. DE 102019103196.6, filed on Feb. 8, 2019, in the German Patent Office. This application is a continuation-in-part of German Patent Application No. DE 102019103196.6, the contents of which are incorporated herein by reference.

TECHNICAL FIELD

The present invention relates to a lower tool for a sealing station or a molding station of a packaging machine that enables a tray sealing machine or a thermoforming packaging machine to be converted or adapted for the production of skin packaging with a flat base plate. Furthermore, the present invention relates to a packaging machine and a method for producing packaging and/or for operating a packaging machine.

BACKGROUND

Plastic packaging is an integral part of the modern world. Since the 1950s, plastic products and especially plastic packaging have been popular with consumers. One of the main areas of application of plastic packaging is food packaging.

Nowadays, it is estimated that as much as 35% of global plastic or plastic consumption is solely due to packaging, for example food packaging (see plastic waste statistics for 2016). This corresponds to around 8% of global oil production, which is used exclusively for the production of plastic or plastic packaging. By 2050, this value could be as high as 20%.

Since packaging is intended mostly as a disposable item, and plastics are only very slowly biodegradable, the popularity of plastic packaging has far-reaching ecological consequences. Every year, around 1,000,000 seabirds and 100,000 marine mammals die from contact with plastic waste, such as packaging, etc. It is also estimated that there is now six times more plastic than plankton in much of the sea.

In order to contain such ecological problems and to strengthen environmental protection, the Packaging Ordinance was enacted in Europe, which was replaced in Germany by the new Packaging Act (VerpackG), which came into force on Jan. 1, 2019.

The purpose of this packaging law is to reduce plastic waste, strengthen the recycling of plastics and promote more environmentally friendly packaging. For example, plastic packaging is to be replaced by more environmentally friendly alternatives such as biodegradable packaging made of cardboard or paper.

In practice, such a switch from plastic packaging to more environmentally friendly packaging, in which at least part of the plastic has been replaced by cardboard or paper, is cumbersome and cost-intensive and therefore problematic, particularly in the production of packaging. In the vast majority of cases, new packaging machines must be purchased to manufacture each new packaging type because conventional packaging machines are only suitable or designed for the production of a specific packaging type.

Because a single new packaging machine usually costs several hundred thousand euros, the switch to more environmentally friendly packaging types is problematic for many packaging manufacturers, which represents a major obstacle to the environmental protection efforts mandated by the new packaging law. The present invention enables the switch to more environmentally friendly types of packaging in a simple and economical manner and thus contributes to the practical implementation of the packaging law and to environmental protection.

Packaging machines are known from the prior art that are each suitable or designed for producing a specific type of packaging. For example, conventional tray sealing machines and thermoforming packaging machines are designed exclusively to produce packaging with a tray-shaped carrier in which the product to be packaged lies. Conventionally, such tray-shaped carriers are usually plastic trays in which the product, such as meat or sausage, is placed before each plastic tray is closed or sealed with a transparent film.

Tray sealing machines are understood herein as packaging machines that process prefabricated plastic trays as tray-shaped carriers and seal them after the plastic trays have been filled with a product to be packaged by sealing the filled plastic trays in a sealing station of the packaging machine. This sealing can be skin packaging in which a skin-compatible sealing film encloses the carrier and the product to be packaged like a second skin.

In thermoforming packaging machines, the plastic trays used as tray-shaped carriers are usually formed in the packaging machine itself by thermoforming a plastic plate or a stronger plastic film in a molding station of the packaging machine before the plastic trays are each filled with the product to be packaged. The plastic trays are then closed or sealed in a sealing station of the packaging machine.

Furthermore, packaging machines are known that are designed exclusively to produce packaging with a flat carrier, such as a flat base plate or a cardboard tray, on which the product to be packaged rests. Such flat carriers or carrier materials are used in particular for the presentation of high-quality products, such as salmon. After placing a product to be packaged on the flat carrier or the carrier material, the packaging is usually closed or sealed with a skin-compatible transparent film. Such packaging is also called skin packaging.

A skin-capable film is to be understood here as a film which, after being applied in the heated state, surrounds the product to be packaged and the carrier material and, like a second skin, lies against the packaged product and the carrier material.

If both packaging with a tray-shaped carrier (for example plastic trays) and packaging with a flat carrier (for example trays) are to be produced, this usually requires several separate packaging machines, which each exclusively process either tray-shaped carriers, for example made of plastic, or flat carriers, for example made of cardboard. This severely limits the flexibility in the production of packaging and leads to considerable costs when changing the type of packaging that is to be produced.

Due to the initial hurdle of the purchase of new packaging machines, efforts to convert to more environmentally friendly packaging types, such as switching from conventional plastic shell packaging to skin packaging with a flat base plate made of more environmentally friendly cardboard, are made more difficult or are even precluded.

The object of the present invention is to alleviate or completely eliminate the problems of the prior art. The present invention is intended to support and simplify a switch to more environmentally friendly packaging. This object is achieved by using a lower tool in the packaging machine. Further aspects of the invention relate to a set of several lower tools and to using a lower tool to convert or retrofit a packaging machine.

SUMMARY

A novel lower tool enables a packaging machine having a molding station or sealing station with a trough to be used to produce skin packaging having a flat base plate. The packaging machine is a tray sealing machine or a thermoforming packaging machine. The lower tool includes a body base and a flat upper surface and is arranged in the molding station or sealing station of the packaging machine such that the flat upper surface of the lower tool covers the trough. The lower tool fits detachably into a lower tool holder of the packaging machine. During the packaging production, the flat upper surface supports the flat base plate of the packaging. Suction applied via a passage through the flat upper surface is used to hold the flat base plate onto the flat upper surface. The lower tool is a means for converting the packaging machine from producing a first type of packaging having a trough-shaped carrier into producing a second type of packaging that has a flat carrier. In one embodiment, the converted packaging machine does not include a tray holder, and the lower tool replaces the tray holder that was used to produce the first type of packaging.

In another embodiment, a packaging machine includes a molding station or sealing station with a trough and a means for converting the packaging machine into producing a different type of packaging. The packaging machine can be a tray sealing machine or a thermoforming packaging machine. The packaging machine is adapted to produce a first type of packaging having a trough-shaped carrier. The means is adapted to fit detachably into a lower tool holder of the packaging machine such that the means covers the trough. The means converts the packaging machine into producing a second type of packaging that has a flat carrier. A flat upper surface of the means supports the flat carrier of the packaging during packaging production.

A method of producing packaging having a flat base plate uses a packaging machine with a novel lower tool. The lower tool is placed in a molding station of the packaging machine. The lower tool detachably fits into the molding station. The molding station has a trough, and a flat upper surface of the lower tool covers the trough. The flat base plate is held on the flat upper surface of the lower tool using suction generated via a passage through the flat upper surface. The packaging machine also includes a sealing station. An upper tool is arranged in the sealing station in a height-adjustable manner.

Other embodiments and advantages are described in the detailed description below. This summary does not purport to define the invention. The invention is defined by the claims.

BRIEF DESCRIPTION OF THE DRAWING

The accompanying drawings, where like numerals indicate like components, illustrate embodiments of the invention.

DETAILED DESCRIPTION

Figure 1:
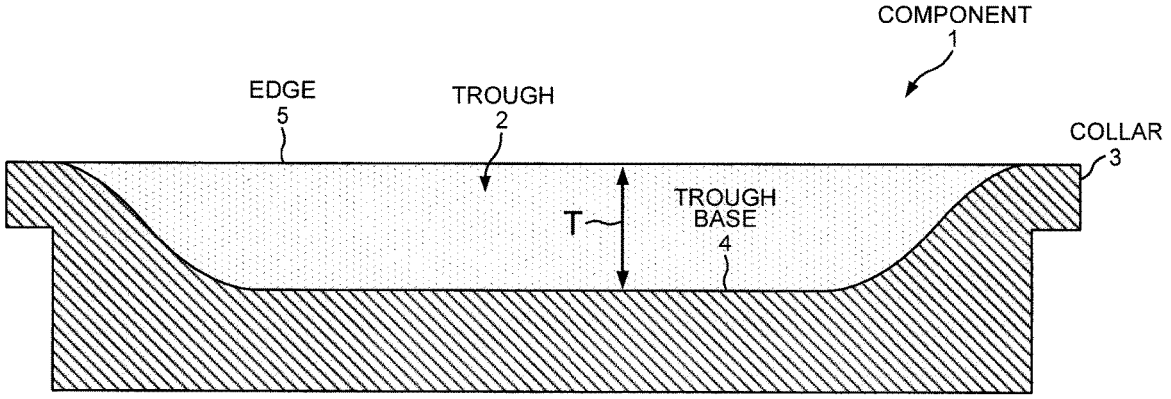
(PRIOR ART) FIG. 1
FIG. 1 (Prior Art) shows a sectional view of a tray holder or a mold trough of a tray sealing machine or a thermoforming packaging machine.

Reference will now be made in detail to some embodiments of the invention, examples of which are illustrated in the accompanying drawings.

The main idea of the present invention is to convert or adapt packaging machines for producing packaging with a tray-shaped carrier (for example plastic trays) in such a way that they can also produce packaging with a flat carrier (for example flat trays). For this purpose, a novel lower tool is provided that can be easily installed, for example, in a tray sealing machine or a thermoforming machine, so that the tray sealing machine or thermoforming machine can also be used for producing packaging with a flat carrier. By producing environmentally friendly packaging with trays made of cardboard, the need to purchase separate packaging machines is eliminated, which makes the production of environmentally friendly packaging easier and more attractive.

A lower tool is installed or mounted in a lower tool holder of a sealing station or a molding station of a packaging machine, such as a tray sealing machine or a thermoforming packaging machine, which enables the tray sealing machine or the thermoforming packaging machine to produce skin packaging with a flat base plate. In other words, the lower tool acts as an adapter or adapter piece that allows the packaging machine to produce skin packaging with a flat base plate. The lower tool is arranged in the packaging machine in such a way that the packaging machine is enabled by the lower tool to produce skin packaging with a flat base plate.

Without such a lower tool, a conventional tray sealing machine (for example a tray sealer) or a conventional thermoforming packaging machine (for example a thermoformer or deep-drawing machine) is only capable of processing trough-shaped (plastic) trays, which are either prefabricated or are produced in the packaging machine by deep-drawing. It is therefore only possible to produce packaging with a tray-shaped or trough-shaped carrier in which a product to be packaged is accommodated.

The present invention makes it possible to produce skin packages with a flat base plate using a tray sealing machine or a thermoforming packaging machine. The carrier materials, such as, for example, cardboard, paper or plastic film, or also other materials that may be used as the carrier material, are preferably made available as rolled goods.

Packaging with a flat carrier, for example a flat base plate made of plastic or cardboard, cannot be produced using a conventional tray sealing machine or a conventional thermoforming packaging machine. To manufacture such packaging, a separate packaging machine must therefore conventionally be purchased, which is designed to produce packaging with a flat carrier, for example a flat base plate made of plastic or cardboard.

In its design, such as its dimensions, the lower tool is designed to be removably or only temporarily disposed on or in the packaging machine, in particular in a lower tool holder, such as a sealing station or a molding station of the packaging machine. The lower tool can be made in one piece or in several pieces and is preferably made of metal, such as aluminum or (high-grade) steel, a metal alloy or plastic. The lower tool is designed to be disposed in the sealing station or the molding station of the packaging machine and to functionally and/or physically replace the tray-receiving trough of the sealing station or the molding trough of the molding station, and to completely or partially fill the tray-receiving trough or the molding trough of the molding station.

If several tray-receiving troughs or molded troughs are provided, the lower tool replaces or fills at least one tray-receiving trough or molding trough. However, it is also possible to replace or fill in several or all of the tray-receiving troughs or molded troughs.

In particular, in the case of a packaging machine with a multi-part tray holder in the sealing station, it is sufficient, for example, if the multiple sections of the multi-part tray holder are removed from the manufacturing process flow, for example by moving the multiple sections of the multi-part tray holder in rest positions in which they no longer participate in the manufacturing process.

The tray holder, tray-receiving trough or molding trough does not necessarily have to be removed from the packaging machine so that a lower tool can be installed. It is sufficient for the lower tool to perform the function or task of the tray holder, tray-receiving trough or molded tray during production of packaging.

The function or task of the tray holder, tray-receiving trough or molding trough in the production of packaging usually consists of carrying or holding carrier material (for example in the form of a plastic tray) to which the product to be packaged is applied during the manufacture of the packaging or, for example, to specify the shape of the plastic shell produced during deep thermoforming. In other words, the lower tool does not necessarily have to physically replace the tray receptacle or tray-receiving trough of the sealing station and/or the molding trough of the molding station; the lower tool can functionally replace them.

It has proven to be advantageous for the lower tool to be essentially cuboid and equipped with at least one completely flat surface. The flat surface is used as a support surface for a flat base plate or a tray of skin packaging when the lower tool is disposed in the sealing station or molding station of the packaging machine. In one embodiment, the lower tool is designed as an insert that can be inserted into a lower tool holder of the packaging machine in order to replace the tray-receiving trough or molded recess of the sealing station or molding station of the packaging machine. Alternatively, the lower tool can be designed as an insert that can be inserted directly into a tray-receiving trough or molding trough of a sealing station or molding station of the packaging machine so that the tray-receiving trough or molding trough of the sealing station or molding station can be partially or completely closed or filled.

The lower tool can have the shape of a plate that simulates the contour of the shell-receiving trough or mold trough and can preferably be inserted into the latter in a substantially play-free manner in order to close the shell-receiving trough or mold trough. The lower tool preferably has a number of cutouts or material recesses on one of the planar surfaces that serves as a support surface for a flat base plate of skin packaging. The cutouts or recesses are preferably spaced apart from one another via ribs or webs. This configuration has the advantage that the lower tool can be made lighter. The ribs or webs ensure that the lower tool has sufficient structural stability and dimensional stability.

Furthermore, the lower tool can have at least one passage through which a vacuum can be created on a surface of the lower tool. The vacuum is generated on the surface of the lower tool, which serves as a support surface for a flat base plate of skin packaging. The passage penetrates the entire thickness of the lower tool and preferably opens on the surface of the lower tool, which serves as a support surface for a flat base plate of skin packaging.

The lower tool can be inserted into the packaging machine with a few hand movements or can be mounted onto the packaging machine with a few hand movements. The lower tool is held mainly by gravity on the packaging machine, the lower tool holder of the sealing station, or on the molding station of the packaging machine. In other words, the lower tool is designed to be held by gravity in the sealing station or molding station of the packaging machine. Alternatively, the lower tool can be held in or on the packaging machine by form engagement or frictional engagement. For example, fastening means in the form of latching connections, plug connections or undercuts can be provided.

The lower tool, is used to convert or retrofit a packaging machine, such as a tray sealing machine or thermoforming packaging machine, to produce another type of packaging, such as packaging with a flat base plate or skin packaging with a flat base. The lower tool can also be used together with an associated dome tool to retrofit a sealing station of a packaging machine.

Conventionally, a tray sealing machine (for example a tray sealer) or a thermoforming packaging machine (for example a thermoformer or deep-drawing machine) could only be used for processing trough-shaped trays or for producing packaging with trough-shaped trays. For the production of packaging with a flat carrier material on which a product to be packaged is placed, for example for producing packaging with a flat base plate made of plastic or cardboard, a separate packaging machine had to be purchased.

The use of a lower tool according to the invention makes it possible, with a conventional tray sealing machine (for example a tray sealer) or a conventional thermoforming packaging machine (for example a thermoformer or deep-drawing machine), to package using a flat carrier material, in particular skin packaging with a flat base plate made of cardboard or plastic, or otherwise from other materials.

The use of at least one lower tool enables a packaging machine, such as a tray sealing machine or thermoforming packaging machine that is adapted to produce a first type of packaging, to be converted to produce a second type of packaging. The second type of packaging differs from the first type of packaging. The first type of packaging can be, for example, packaging such as skin packaging with a tray-shaped or trough-shaped carrier into which a product to be packaged is inserted. The second type of packaging can be, for example, packaging such as skin packaging, with a flat carrier, for example a carrier in the form of a tray and/or flat base plate on which a product to be packaged is placed. In other words, a conventional tray sealing machine or a conventional thermoforming packaging machine can be converted or retrofitted using the lower tool to produce packaging with a flat carrier material, such as skin packaging with a flat base plate made of cardboard or plastic.

Although a single lower tool can be used in the sealing station or molding station of a packaging machine, multiple lower tools can also be used. For example, two lower tools can be used in the sealing station or molding station of a packaging machine.

The lower tool is detachably or non-detachably disposed on or in the packaging machine, such as on or in the sealing station or molding station of the packaging machine.

It is advantageous for the lower tool to be arranged on or in the packaging machine, such as on or in the sealing station or molding station of the packaging machine, in such a way that the lower tool replaces, bridges or fills out a tray holder or tray-receiving trough of the sealing station or a molding trough of the molding station.

A vacuum or suction is generated on a surface of the lower tool while the lower tool is disposed on or in the sealing station or molding station of the packaging machine, which acts as a support surface for a flat base plate of skin packaging. The suction reduces slippage of the flat base plate and of the tray of skin packaging.

The lower tool is arranged on or in the sealing station or molding station of the packaging machine such that the lower tool is held mainly by gravity in the sealing station or molding station of the packaging machine. The lower tool can also be held completely or exclusively by gravity in the sealing station or molding station of the packaging machine In another embodiment, the lower tool is arranged on or in the sealing station or molding station of the packaging machine in such a way that the lower tool is held by a fastening element, such as a detent connection or a plug connection. The lower tool can also be held by friction, form fit or by an undercut on or in the sealing station or molding station of the packaging machine.

Another aspect of the present invention involves a set of different bottom tools for converting a packaging machine, such as a tray sealing machine or thermoforming packaging machine that is designed for producing a first packaging type, into producing several additional types of packaging that differ from the first type of packaging and from each other. The set includes an arbitrary number of lower tools. The first type of packaging can be skin packaging with a tray-shaped or trough-shaped carrier into which a product to be packaged is inserted. The tray-shaped or trough-shaped carrier used for the first type of packaging has a defined trough depth and trough shape. The second type of packaging can be skin packaging with a flat carrier, for example a carrier in the form of a tray or flat base plate on which the product to be packaged is placed. The third type of packaging can differ from that used by the first type of packaging only in the trough depth or trough shape of the tray-shaped or trough-shaped carrier.

The lower tools of a set can each have a trough that is designed differently than the tray-receiving trough of the sealing station or the molding trough of the molding station of the packaging machine. The set can, for example, have different lower tools or inserts, each with different trough depths and trough shapes. Thus, the set can include several different lower tools.

The set can also include a plurality of lower tools, of which only some of lower tools include passages through which a vacuum is generated on the surface of each lower tool. The surface of each lower tool serves as a support surface for a carrier material, such as a flat base plate of skin packaging. The vacuum that is generated improves the support of the support material on the support surface because the support material is sucked onto the support surface, thereby preventing the support material from slipping.

In another embodiment, a method of using a packaging machine, such as tray sealing machine or thermoforming packaging machine, to produce skin packaging having a flat base involves the steps of arranging, installing and assembling a removable or permanent lower tool on or in a sealing station or molding station of the packaging machine. Another embodiment involves a method of operating a packaging machine that uses the lower tools. The present invention thus includes both a method for producing packaging using the recited packaging machine with a lower tool and a method of operating that packaging machine.

The lower tool is disposed in a lower tool holder of the packaging machine. The packaging machine may have only a single lower tool or several lower tools. In addition, the packaging machine can also have only one lower tool holder or a plurality of lower tool holders. Each lower tool is held in a lower tool holder.

A packaging machine, such as a tray sealing machine or thermoforming packaging machine, includes a lower tool that allows the packaging machine to be used to produce packaging, such as skin packaging, that has a flat base plate. The lower tool can be arranged on or in the sealing station or molding station of the packaging machine in a fixed/non-detachable manner or in a removable/detachable manner. The lower tool can therefore either be permanently installed on or in the packaging machine so as to convert it permanently, or the lower tool can be temporarily arranged on or in the packaging machine and then removed from the packaging machine.

The lower tool is held in the sealing station of the tray sealing machine or in the molding station of the packaging machine mainly by gravity or by gravity and a vacuum. If the lower tool is held only or mainly by gravity in or on the packaging machine, the mounting of the lower tool in or on the packaging machine is particularly simple because the lower tool only has to be placed on a supporting section of the packaging machine and can be inserted into a corresponding recess and can be easily removed.

In the area of the sealing station, the packaging machine has a height-adjustable upper tool with a dome tool and/or a height-adjustable upper tool holder and/or a height-adjustable lower tool and/or a height-adjustable lower tool holder.

A skin-compatible sealing film is deformed in the sealing station of the packaging machine using the upper tool and the dome tool contained therein before the sealing film is used to seal the skin packaging. Such a configuration makes it possible to package products of different heights and sizes with the packaging machine because the upper tool and lower tool can each be positioned according to the height and size of the product being packaged.

In another embodiment, a packaging machine has a tray holder that is formed in one piece or in multiple pieces, and the lower tool replaces the tray holder. The lower tool replaces the shell holder or the task and function of the shell holder during production. The tray receptacle therefore does not necessarily have to be removed from the packaging machine during operation. In the case of multi-piece tray receptacles, the individual sections of the multi-piece tray receptacle can be moved into rest positions in which they no longer participate in the manufacturing process flow.

It is still possible to print the packaging while it is in the packaging machine if at least one lower tool is disposed in the packaging machine, preferably in the sealing station or molding station of the packaging machine.

FIG. 1 (Prior Art) shows schematically a component 1 with a recess or trough 2 that can be used as a tray holder in a sealing station of a tray sealing machine or in a molding station of a thermoforming packaging machine. The trough 2 can serve as a tray-receiving trough or as a molding trough.

The component 1 has a substantially cuboid base body with a circumferential projection or collar 3 on the side towards which the trough 2 is open. Depending on the application, the circumferential collar 3 serves to secure the component 1 and to prevent it from being inserted too deeply when the component 1 is inserted, for example, into a recess in a receptacle of a packaging machine.

The trough 2 has a depth T that extends between the trough base 4 and an edge 5 that forms the upper edge of the trough 2.

Figure 2:
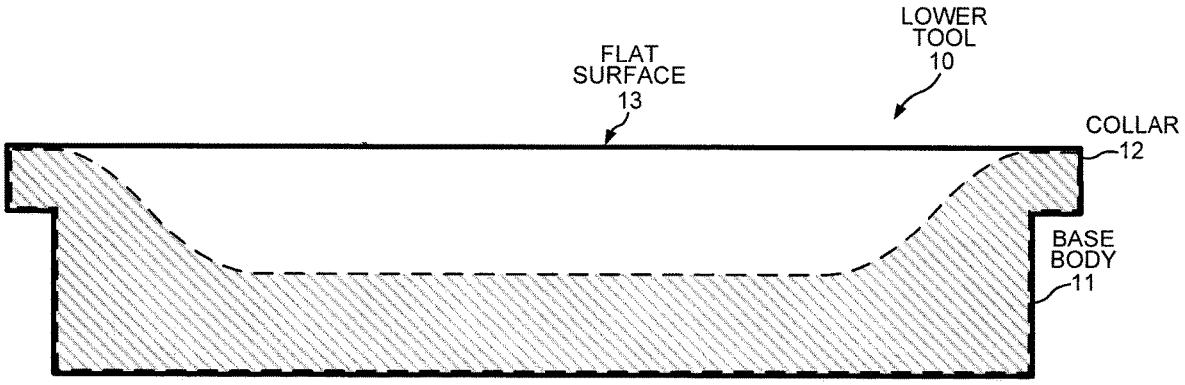
FIG. 2 shows a sectional view of a lower tool according to a first embodiment of the invention (represented by the bold line).

FIG. 2 shows a lower tool 10 according to the invention that can be installed in a packaging machine in order to replace a component like the component 1 shown in FIG. 1 with a shell receptacle or mold trough.

In FIG. 2, the lower tool 10 is shown with a bold line. The component 1, which represents the shell holder or mold cavity, is depicted with thinner lines. The component 1 is outlined in broken lines in FIG. 2 and subsequent figures to indicate that the component does not form part of the lower tool 10. The component 1 is only shown in FIG. 2 for the sake of clarity and so that it is apparent that the lower tool 10 according to the invention partially or completely reproduces the contours of the conventional component 1 and thus replaces the component 1, for example, in the lower tool holder of a packaging machine. The lower tool 10 includes the features outlined in FIG. 2 by the bold line but not the features represented in FIG. 2 only by the thinner lines. This also applies to the other FIGS. 3-8.

As shown in FIG. 2, the lower tool 10 has a substantially cuboid base body 11 with a partially or completely circumferential projection or collar 12. Similar to the circumferential collar 3, the circumferential collar 12 serves to secure the lower tool 10 against being inserted too deeply when the lower tool 10 is inserted, for example, into a recess in a receptacle of a packaging machine.

The lower tool 10 has a flat upper surface 13, which serves as a support surface for flat carrier materials (e.g., trays or plates made of cardboard or paper) for packaging. The surface 13 is preferably completely flat and has no cutouts or depressions that are designed to carry or hold shell-shaped or trough-shaped carrier materials for packaging.

Figure 3:
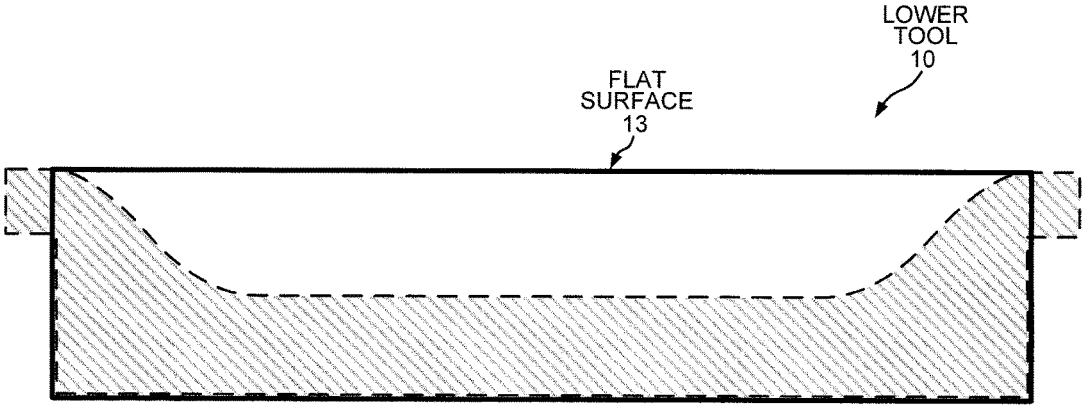
FIG. 3 shows a sectional view of a lower tool according to a second embodiment of the invention (represented by the bold line).

FIG. 3 shows a further embodiment of a lower tool 10 according to the invention. In this embodiment, the lower tool 10 has the shape of a cuboid or essentially has the shape of a cuboid, but does not have a projection/collar 12. The dimensions of the lower tool are selected so that the lower tool fits into a lower tool holder of a packaging machine and can be inserted into it.

The lower tool 10 can in principle be of solid design or also have a cutout or a plurality of cutouts that serve to reduce the weight of the lower tool. Such a recess or recesses are, however, preferably not provided on the flat surface 13, or are formed there only so small that the best possible support of the flat carrier material on the surface 13 is not endangered despite the recess or recesses.

Figure 4:
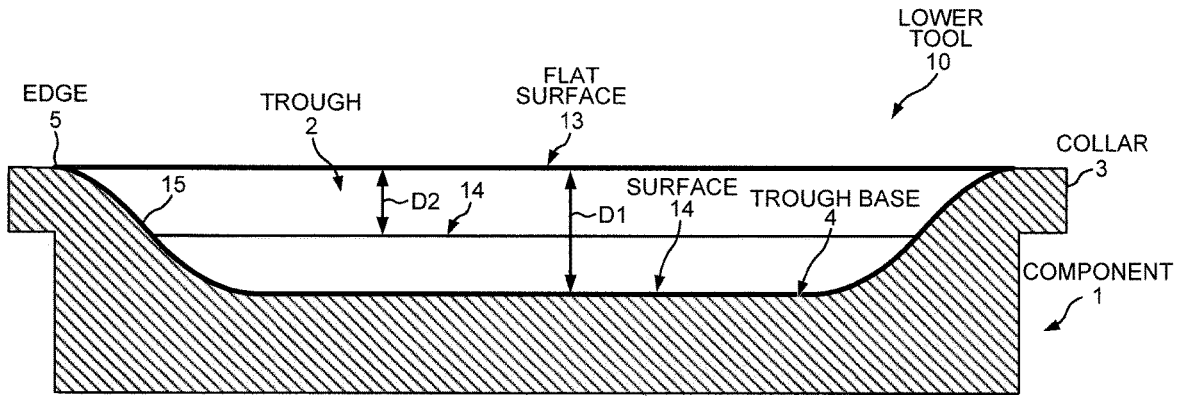
FIG. 4 shows a sectional view of a lower tool according to a third embodiment of the invention (represented by the bold line).

FIG. 4 shows a further embodiment of a lower tool 10 according to the invention. The lower tool 10 of this embodiment supplements the component 1, which is the tray receptacle or mold trough. But the component 1 and therefore the tray receptacle or mold trough remain in the packaging machine to be converted. According to this embodiment, the lower tool 10 is designed such that it fits into the trough 2, which functions as a tray-receiving depression of a sealing station or as a molding depression of a forming station of a packaging machine, and preferably fills it completely.

The flat surface 13 (support surface for flat carrier materials) of the lower tool 10 thus forms a continuous and essentially flat surface with an edge 5 that forms the edge of the trough 2 when the lower tool 10 is inserted or fitted into the trough 2 as shown in FIG. 4. The plane defined by the surface 13 of the lower tool 10 is thus continued through the edge 5 and adjoins the edge surface of the collar 3 so that a continuous layer is formed.

A surface 14 of the lower tool 10 opposite the surface 13 reproduces the contour of the trough base 4 of the trough 2 and of the curved side outlets or trough spouts 15. A thickness D1 of the lower tool 10, which extends between the surfaces 13 and 14, corresponds to the depth T of the trough 2 in which the lower tool 10 can be used. Here, the surface 13 of the lower tool 10, with the edge 5 and a surface of the collar 3 adjoining this edge, forms a continuous and preferably flat support surface for carrier materials.

Alternatively, the lower tool can have only a thickness D2. The thickness D2 of the lower tool 10, which extends between the surfaces 13 and 14, can in principle be less than the depth T of the trough 2 into which the lower tool 10 is inserted. In this case, the lower tool 10 has the shape of a cover that fits into the trough 2 and closes it so that a substantially flat or completely flat surface is formed between the surface 13 of the lower tool 10 and the edge 5 of the trough edge of the trough 2. In this embodiment, there is a gap between the surface 14 and the trough base 4.

Figure 5:
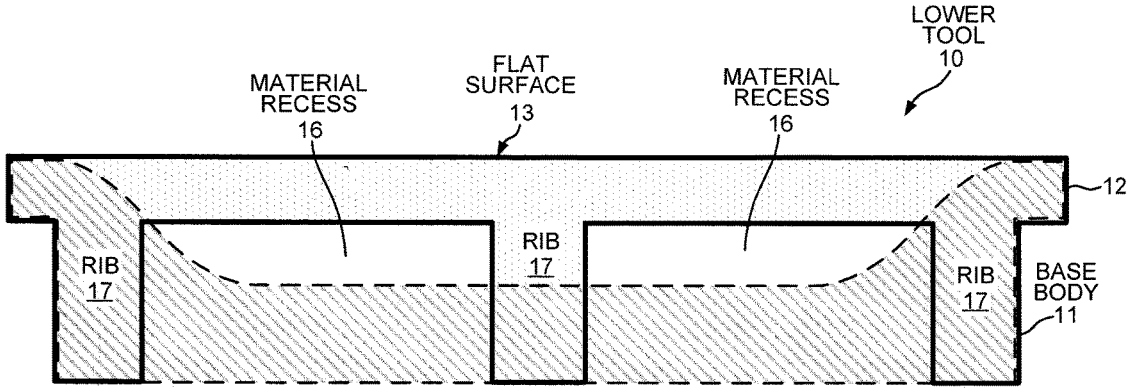
FIG. 5 shows a sectional view of a lower tool according to a fourth embodiment of the invention (represented by the bold line).

As shown in FIG. 5, the lower tool 10 can have any number of cutouts or material recesses 16 on a side opposite the surface 13, which are separated or distanced by means of webs or ribs 17. In contrast to a solidly designed lower tool, a lower tool with such recesses or material recesses is significantly lighter.

Figure 6:
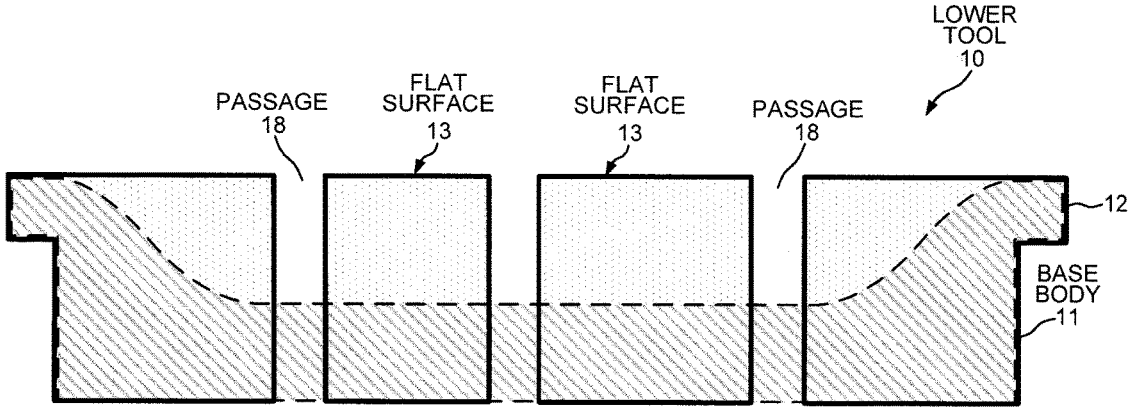
FIG. 6 shows a sectional view of a lower tool according to a fifth embodiment of the invention (represented by the bold lines).

As shown in FIG. 6, the lower tool 10 can furthermore have passages 18, which are preferably open on the surface 13 and preferably extend over or through the entire thickness of the lower tool. The passages 18 can be used to generate suction and to apply a vacuum to the surface 13, which holds a carrier material lying on the surface 13 for packaging and secures the carrier material against slipping. For ease of illustration, the passages 18 are shown very large in FIG. 6. In fact, the passages 18 can have a diameter of only one or a few millimeters, or only a fraction of a millimeter, or even only a few microns. The passages 18 can be enclosed on all sides by the material of the lower tool 10 and thus form locally very limited recesses in the lower tool 10 or the base body 11 of the lower tool 10. The lower tool 10 can be formed in one piece. Alternatively, the lower tool 10 can also be constructed in several pieces and preferably have a number of parts that can be detached from one another.

Figure 7:
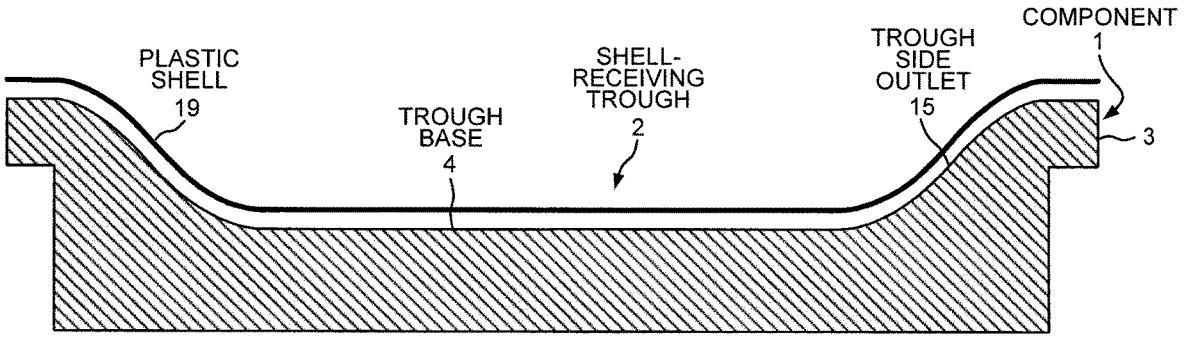
(PRIOR ART) FIG. 7
FIG. 7 (Prior Art) illustrates how a plastic tray is received in a tray-receiving trough of a sealing station of a tray closing machine and how a plastic film is brought into a tray-shaped form in a molding trough of a molding station of a thermoforming packaging machine.

FIG. 7 (Prior Art) illustrates how a plastic shell 19 of a sealing station of a tray sealing machine is received in a shell-receiving trough (trough 2 of the component 1) of a conventional tray sealing machine or thermoforming packaging machine. FIG. 7 also shows how a plastic shell 19 of a sealing station of a tray sealing machine is brought into a tray-shaped form as a plastic foil 19 in a mold cavity (trough 2 of the component 1) of a molding station of a thermoforming packaging machine. The component 1 with the trough 2 can be used either as a tray holder or as a molding trough of a packaging machine.

As shown in FIG. 7, the contour of the plastic shell 19 or plastic film 19 follows the contour of the trough 2 or the contour of the trough base 4 and the curved trough side outlets 15. If component 1 is used in a sealing station of a tray sealing machine, a plastic tray 19 is placed in the tray-receiving trough (trough 2 of component 1) for each package to be manufactured. If component 1 is used in a molding station of a thermoforming packaging machine, a section of a plastic film 19 is placed in a mold cavity (trough 2 of component 1) of the molding station of the thermoforming packaging machine for each package to be produced by applying a vacuum or compressed air into a tray-shaped mold following the contour of the trough 2.

Figure 8:
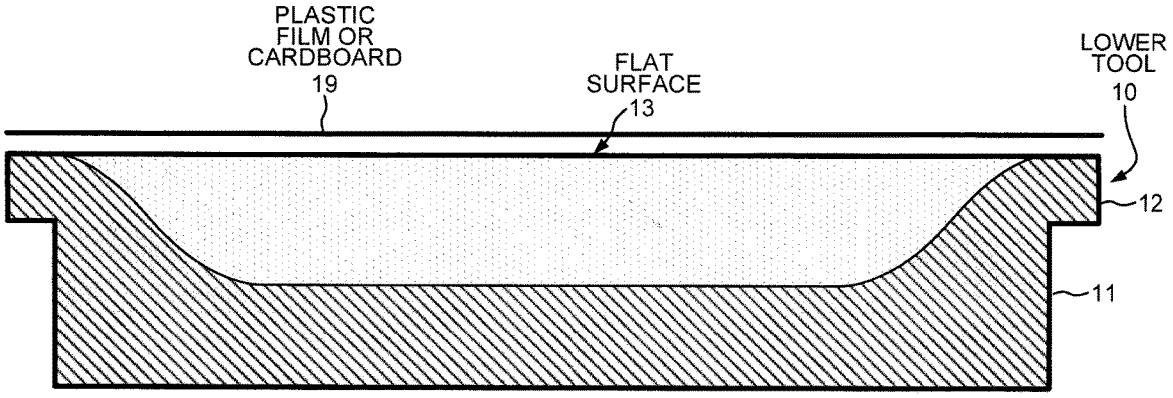
FIG. 8 illustrates how a flat base plate, for example a tray of skin packaging, is carried by a lower tool according to the invention.

FIG. 8 illustrates how a flat carrier or base plate, for example a tray of skin packaging or plastic film, which is suitable for serving as a flat base plate for packaging, is carried by the flat surface 13 of the lower tool 10. The flat surface 13 replaces the trough base 4 and the trough side outlets 15 as the contact surface of the plastic film 19 or base plate or tray made of cardboard 19.

Figure 9:
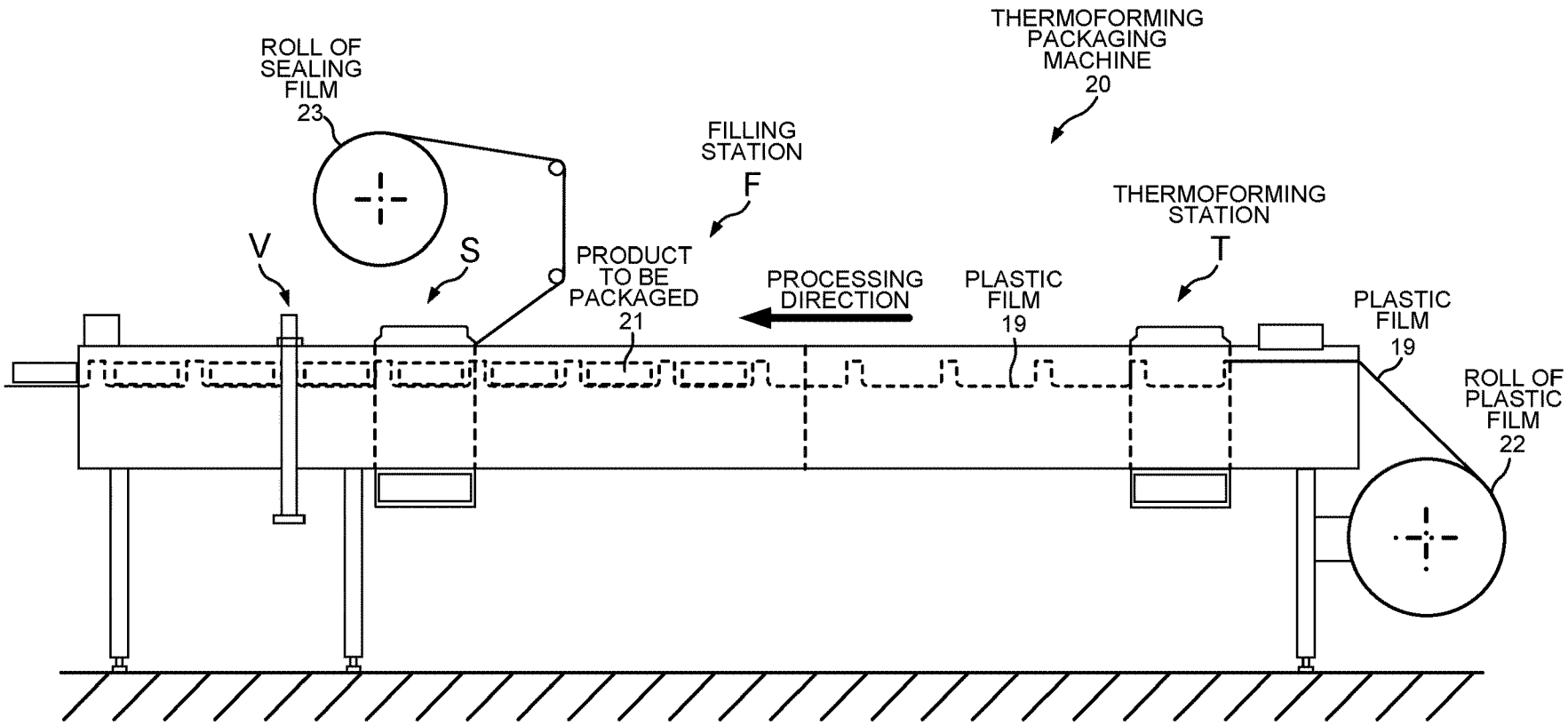
(PRIOR ART) FIG. 9
FIG. 9 (Prior Art) shows a conventional thermoforming packaging machine.

FIG. 9 (Prior Art) shows a conventional thermoforming packaging machine 20 that includes a thermoforming station T, a filling station F, a sealing station S and a separating station V. Machine 20 has a molding station, which in this case is the thermoforming station T in which plastic trays are molded by thermoforming plastic film that serves as a carrier material. In the filling station F, the plastic trays that are molded at the molding station are each filled or loaded with a product to be packaged 21. In the sealing station S, the filled plastic shells 19 are closed or sealed with a plastic film. The individual packages are then separated or isolated from one another in the separating station V by cutting the individual sealed packages apart. The plastic film 19, which serves as a carrier material, is fed to the packaging machine 20 from a roll 22. The plastic film used for sealing is fed to the packaging machine 20 from a roll 23.

The processing direction or the process flow of the packaging production takes place from right to left in the illustration in FIG. 9. The conventional thermoforming packaging machine 20 shown in FIG. 9 is designed to produce only packaging with tray-shaped or trough-shaped carriers (plastic trays) and not to produce packaging with a flat base plate (tray).

Figure 10:
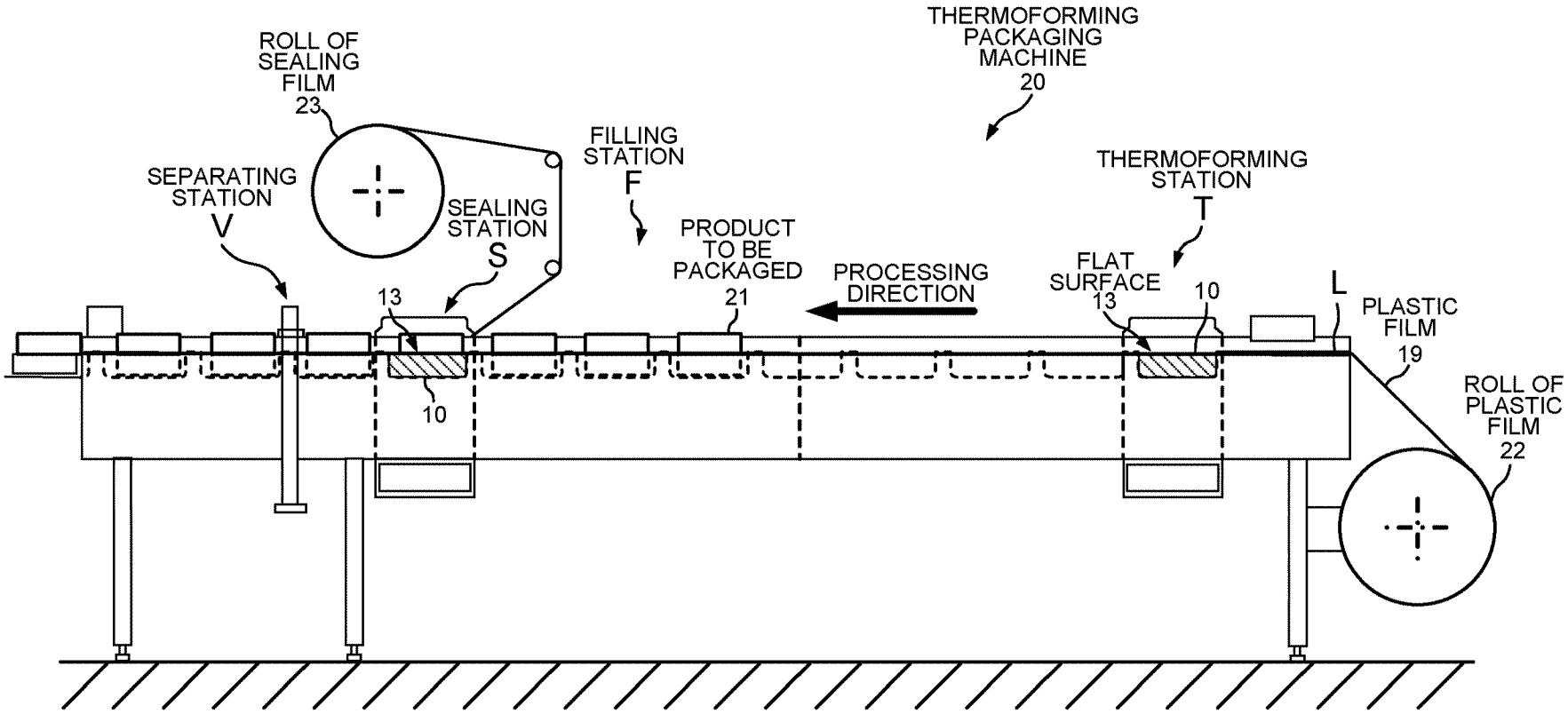
FIG. 10 shows a thermoforming packaging machine with a lower tool according to the invention.

FIG. 10 shows the thermoforming packaging machine 20 of FIG. 9, in which a lower tool 10 according to the invention has been installed in the molding station or thermoforming station T and in the sealing station S. The processing direction or the process flow of packaging production also takes place from right to left in the illustration in FIG. 10.

The plastic film 19 or, alternatively, cardboard fed into the packaging machine as carrier material moves in the process flow in the molding station/thermoforming station T and in the sealing station S over a flat surface 13 of a lower tool 10 and is carried thereon, as shown by the bold line L in FIG. 10. The lower tool 10 bridges the recess in the process flow defined by the trough 2. If at least one lower tool 10 is arranged in the packaging machine, for example at the molding station, the carrier material is no longer deformed, but instead passes through the packaging machine as a flat plate, as shown by the bold line L in FIG. 10. The troughs are shown in FIG. 10 only so as to provide a direct comparison in a single figure between the conditions in a packaging machine without the lower tool 10 (as in FIG. 9) and in a packaging machine with at least one lower tool 10 (as in FIG. 10).

The cardboard or plastic film 19 used as the carrier material thus retains its flat or planar shape due to the arrangement of the lower tool 10 in the thermoforming station T and is not deep-drawn by the packaging machine in the thermoforming station.

In addition, the surface 13 of the lower tool carries the cardboard box or plastic film 19 so that a less rigid or dimensionally stable cardboard box or plastic film 19 can also be processed in the packaging machine 20 without the cardboard box or plastic film 19 passing through the thermoforming station T being deformed or twisted, as would be the case if the thermoforming station T were only deactivated (by turning off the compressed air or vacuum, etc.) without a lower tool 10 being arranged in the thermoforming station T.

In a mode for producing packaging with a flat base area in which the lower tool 10 is arranged in the thermoforming station T of the packaging machine 20, any vacuum used in the thermoforming station T to produce plastic trays for packaging with tray-shaped carriers can be switched off.

The lower tool 10 in the thermoforming station T and/or sealing station S can, however, also have passages 18 through which a vacuum or suction can be generated on the surface 13 of the lower tool 10 so that the plastic film or cardboard is prevented from slipping over the surface 13. In this case, the vacuum in the thermoforming station T and/or the sealing station S remains turned on and is connected to the passages 18 so that the plastic film or the cardboard is sucked onto the surface 13.

In the filling station F, a product 21 to be packaged is placed on the flat base plate serving as the carrier material, for example the plastic film 19 or the cardboard serving as the carrier material. If cardboard is used as the carrier material for packaging with a flat base plate, then either prefabricated trays can be used, or the trays are produced in the packaging machine itself. This is analogous to using prefabricated plastic trays or plastic trays created by thermoforming in the packaging machine itself in packaging with tray-shaped carriers.

So that products 21 of different sizes or heights can be packaged using the packaging machine 20, the lower tool 10 and/or an upper tool in the sealing station S, which preferably includes a dome tool, is preferably arranged in a height-adjustable manner in the sealing station S.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A lower tool for a packaging machine, comprising:

a body base; and a flat upper surface, wherein the lower tool is adapted to fit in a lower tool holder of the packaging machine, wherein the packaging machine has a molding station or sealing station with a trough, wherein the flat upper surface of the lower tool bridges the trough, wherein the trough has an upper contour, wherein the flat upper surface of the lower tool has an outer edge that extends at least to the upper contour of the trough and thereby covers the trough, wherein the flat upper surface of the lower tool is used by the packaging machine to produce packaging having a flat base plate, and wherein the packaging machine is taken from the group consisting of: a tray sealing machine and a thermoforming packaging machine.

2. The lower tool of claim 1, wherein the lower tool detachably fits into the lower tool holder of the packaging machine.

3. The lower tool of claim 1, wherein the lower tool is formed from a plurality of separate pieces.

4. The lower tool of claim 1, wherein the packaging machine does not include a tray holder, and wherein the lower tool is adapted to replace the tray holder.

5. The lower tool of claim 1, wherein the lower tool is cuboid, and wherein the flat upper surface supports the flat base plate of the packaging.

6. The lower tool of claim 1, wherein the lower tool is a solid object with a material recess opposite the flat upper surface, and wherein the material recess is bounded by ribs that support the flat upper surface.

7. The lower tool of claim 1, wherein a passage is disposed in the flat upper surface, and wherein the passage is adapted to allow suction through the passage to hold the flat base plate onto the flat upper surface.

8. The lower tool of claim 1, wherein the lower tool is held in place in the lower tool holder by a fastener.

9. The lower tool of claim 1, wherein the lower tool is held in place in the lower tool holder only by gravity.

10. The lower tool of claim 1, wherein the lower tool is at least partially made of metal.

11. A packaging machine, comprising:

a molding station, wherein the packaging machine is adapted to produce a first type of packaging having a trough-shaped carrier produced using a trough of the molding station, wherein the trough has an upper contour, and wherein the packaging machine is taken from the group consisting of: a tray sealing machine and a thermoforming packaging machine; and means for converting the packaging machine into producing a second type of packaging that has a flat carrier, wherein the means is adapted to fit into a lower tool holder of the packaging machine, wherein a flat upper surface of the means supports the flat carrier of the packaging, and wherein the flat upper surface has an outer edge that extends at least to the upper contour of the trough and thereby covers the trough.

12. The packaging machine of claim 11, wherein the means fits detachably into the lower tool holder of the packaging machine.

13. The packaging machine of claim 11, wherein the means is a solid object with a material recess opposite the flat upper surface, and wherein the material recess is bounded by ribs that support the flat upper surface.

14. The packaging machine of claim 11, wherein the packaging machine that is adapted to produce the first type of packaging includes a tray holder, wherein the packaging machine after converting does not include the tray holder, and wherein the means replaces the tray holder.

15. The packaging machine of claim 11, wherein a passage passes through the means, and wherein the passage is adapted to allow suction through the passage to hold the flat carrier onto the flat upper surface of the means.

16. The packaging machine of claim 11, wherein the means is held in place in the lower tool holder by a fastener.

17. The packaging machine of claim 11, wherein the means is held in place in the lower tool holder only by gravity.

18. A method of producing packaging having a flat base plate using a packaging machine, comprising:

placing a lower tool in a molding station of the packaging machine, wherein the molding station has a trough, wherein a flat upper surface of the lower tool bridges the trough, wherein the trough has an upper contour, wherein the flat upper surface of the lower tool has an outer edge that extends at least to the upper contour of the trough and thereby covers the trough, and wherein the packaging machine is taken from the group consisting of: a tray sealing machine and a thermoforming packaging machine.

19. The method of claim 18, wherein the lower tool detachably fits into the molding station.

20. The method of claim 18, wherein the packaging machine includes a sealing station, further comprising:

arranging an upper tool in the sealing station in a height-adjustable manner.

* * * * *